US012624501B2

(12) United States Patent
Heiskanen et al.

(10) Patent No.: US 12,624,501 B2
(45) Date of Patent: May 12, 2026

(54) METHOD FOR MANUFACTURING A BARRIER FILM COMPRISING HIGHLY REFINED CELLULOSE

(71) Applicant: Stora Enso OYJ, Helsinki (FI)

(72) Inventors: Isto Heiskanen, Imatra (FI); Kaj Backfolk, Lappeenranta (FI); Katja Lyytikäinen, Imatra (FI); Anders Moberg, Hammarö (SE); Jukka Kankkunen, Imatra (FI)

(73) Assignee: Stora Enso OYJ, Helsinki (FI)

( * ) Notice: Subject to any disclaimer, the term of this patent is extended or adjusted under 35 U.S.C. 154(b) by 245 days.

(21) Appl. No.: 18/548,368

(22) PCT Filed: Mar. 8, 2022

(86) PCT No.: PCT/IB2022/052037
§ 371 (c)(1),
(2) Date: Aug. 30, 2023

(87) PCT Pub. No.: WO2022/189958
PCT Pub. Date: Sep. 15, 2022

(65) Prior Publication Data

US 2024/0133118 A1 Apr. 25, 2024
US 2024/0229358 A9 Jul. 11, 2024

(30) Foreign Application Priority Data

Mar. 10, 2021 (SE) ..... 2150272-9

(51) Int. Cl.

| | |
|---|---|
| ***D21H 11/18*** | (2006.01) |
| ***D21F 1/80*** | (2006.01) |
| ***D21F 9/00*** | (2006.01) |
| ***D21H 23/28*** | (2006.01) |
| ***D21H 23/48*** | (2006.01) |
| ***D21H 27/30*** | (2006.01) |

(52) U.S. Cl.
CPC ..... *D21H 11/18* (2013.01); *D21F 1/80* (2013.01); *D21F 9/003* (2013.01); *D21H 23/28* (2013.01); *D21H 23/48* (2013.01); *D21H 27/30* (2013.01)

(58) Field of Classification Search
CPC ..... D21H 11/18; D21H 23/28; D21H 23/48; D21H 27/30; D21F 1/80; D21F 9/003
See application file for complete search history.

(56) References Cited

U.S. PATENT DOCUMENTS

2004/0180184 A1* 9/2004 Fillion ..... D21H 11/10 428/211.1
2004/0256067 A1* 12/2004 Leskela ..... D21H 17/675 162/149
2005/0194477 A1 9/2005 Suzuki
2018/0187377 A1* 7/2018 Ziegenbein ..... D21H 27/30
2018/0245286 A1 8/2018 Heiskanen et al.
2019/0091982 A1 3/2019 Heiskanen et al.
2019/0106841 A1* 4/2019 Burazin ..... D21H 27/002
2019/0231919 A1* 8/2019 Mehnert ..... A61M 15/08
2020/0023627 A1 1/2020 Heiskanen et al.
2020/0063353 A1* 2/2020 Everett ..... D21F 1/40
2020/0239652 A1 7/2020 Saukkonen et al.

FOREIGN PATENT DOCUMENTS

JP 2019023360 A 2/2019
JP 2019026651 A * 2/2019 ..... C12P 19/04
WO 2016097964 A1 6/2016
WO 2017046749 A1 3/2017
WO 2017168353 A1 10/2017
WO 2017221137 A1 12/2017
WO 2020095254 A1 5/2020

OTHER PUBLICATIONS

International Search Report from corresponding PCT application No. PCT/IB2022/052037, mailed Apr. 27, 2022.
Extended European Search Report from corresponding European application No. 22766476.0, dated Dec. 19, 2024.

* cited by examiner

*Primary Examiner* — Abbas Rashid
*Assistant Examiner* — Stephen M Russell
(74) *Attorney, Agent, or Firm* — Greer Burns & Crain Ltd.

(57) ABSTRACT

The present invention relates to a method for manufacturing a barrier film comprising highly refined cellulose, said method comprising: a) providing a highly refined cellulose pulp suspension comprising highly refined cellulose pulp having a Schopper-Riegler (SR) number in the range of 40-98 as determined by standard ISO 5267-1 and a content of fibers having a length >0.2 mm of at least 7 million fibers per gram based on dry weight, at a consistency in the range of 0.1-1.5 wt %; b) forming a web of the highly refined cellulose pulp suspension and dewatering the web in a paper machine former on a wire to a consistency of at least 5 wt % to obtain a substrate web, wherein the white water removed from the pulp contains 2-25 wt %, preferably 5-20 wt % and more preferably at least 5-15 wt % of the solids of the highly refined cellulose pulp suspension provided in step a); c) optionally further dewatering and optionally drying the substrate web; d) coating the optionally further dewatered and optionally dried substrate web with a coating suspension comprising cellulose fines or microfibrillated cellulose to obtain a coated web; and e) dewatering and/or drying the coated web to obtain a barrier film comprising highly refined cellulose.

23 Claims, No Drawings

METHOD FOR MANUFACTURING A BARRIER FILM COMPRISING HIGHLY REFINED CELLULOSE

This application is a U.S. National Phase under 35 U.S.C. § 371 of International Application No. PCT/IB2022/052037, filed Mar. 8, 2022, which claims priority under 35 U.S.C. §§ 119 and 365 to Swedish Application No. 2150272-9 filed Mar. 10, 2021.

TECHNICAL FIELD

The present disclosure relates to barrier films, e.g. gas, aroma, and/or moisture barrier films useful in paper and paperboard based packaging materials. More specifically, the present disclosure relates to methods for manufacturing barrier films comprising highly refined cellulose fibers.

BACKGROUND

Effective gas, aroma, and/or moisture barriers are required in packaging industry for shielding sensitive products. Particularly, oxygen-sensitive products require an oxygen barrier to extend their shelf-life. Oxygen-sensitive products include many food products, but also pharmaceutical products and electronic industry products. Known packaging materials with oxygen barrier properties may be comprised of one or several polymer films or of a fibrous paper or board coated with one or several layers of an oxygen barrier polymer, usually as part of a multilayer coating structure. Another important property for packaging for food products is resistance to grease and oil.

More recently, films produced from highly refined cellulose and microfibrillated cellulose (MFC) have been developed, in which defibrillated cellulosic fibrils have been suspended e.g. in water, re-organized and rebonded together to form a continuous film. Such films have been found to provide good gas barrier properties as well as good resistance to grease and oil.

The films can be made by applying a highly refined cellulose suspension on a porous substrate forming a web followed by dewatering of the web by draining water through the substrate for forming the film. Formation of the web can be accomplished e.g. by use of a paper- or paperboard machine type of process. The porous substrate may for example be a membrane or wire fabric or it can be a paper or paperboard substrate.

Manufacturing of films and barrier substrates from highly refined cellulose or MFC suspensions on a paper machine is difficult because of the high water retention and/or high drainage resistance of the suspensions and the formed webs. Rapid or forced dewatering, e.g. assisted by pressure or suction tends to lead to high loss of fines from the web, or uneven vertical distribution of fines in the web, and formation of pinholes, resulting in a film with poor barrier properties. On the other hand, reducing the dewatering speed to prevent these problems will require an excessively long dewatering section.

A problem with webs and films formed from highly refined cellulose or MFC suspensions is that they will typically exhibit poor tensile and tearing strength.

From a technical and economical point of view, it would be preferable to find a solution that enables fast dewatering, and at the same time improves the film barrier and tear strength properties.

DESCRIPTION OF THE INVENTION

It is an object of the present disclosure to provide a method for manufacturing a barrier film comprising highly refined cellulose fibers, which alleviates at least some of the above mentioned problems associated with prior art methods.

It is a further object of the present disclosure to provide an improved method for manufacturing a barrier film comprising highly refined cellulose fibers in a paper- or paperboard machine type of process.

It is a further object of the present disclosure to provide a barrier film useful as a gas barrier in a paper or paperboard based packaging material which is based on renewable raw materials.

It is a further object of the present disclosure to provide a barrier film useful as a gas barrier in a paper or paperboard based packaging material with high repulpability, providing for high recyclability of packaging products comprising the barrier film.

The above-mentioned objects, as well as other objects as will be realized by the skilled person in the light of the present disclosure, are achieved by the various aspects of the present disclosure.

According to a first aspect illustrated herein, there is provided a method for manufacturing a barrier film comprising highly refined cellulose, said method comprising:

a) providing a highly refined cellulose pulp suspension comprising highly refined cellulose pulp having a Schopper-Riegler (SR) number in the range of 40-98 as determined by standard ISO 5267-1 and a content of fibers having a length >0.2 mm of at least 7 million fibers per gram based on dry weight, at a consistency in the range of 0.1-1.5 wt %;

b) forming a web of the highly refined cellulose pulp suspension and dewatering the web in a paper machine former on a wire to a consistency of at least 5 wt % to obtain a substrate web, wherein the white water removed from the pulp contains 2-25 wt %, preferably 5-20 wt % and more preferably at least 5-15 wt % of the solids of the highly refined cellulose pulp suspension provided in step a);

c) optionally further dewatering and optionally drying the substrate web;

d) coating the optionally further dewatered and optionally dried substrate web with a coating suspension comprising cellulose fines or microfibrillated cellulose (MFC) to obtain a coated web; and e) dewatering and/or drying the coated web to obtain a barrier film comprising highly refined cellulose.

The inventive method allows for efficient manufacturing a barrier film comprising highly refined cellulose in a paper machine type of process. Such films have been found to be very useful, e.g., as gas barrier films in packaging applications. The films can be used to replace conventional barrier films, such as synthetic polymer films or aluminum foils which reduce the recyclability of paper or paperboard packaging products. The inventive films have high repulpability, providing for high recyclability of the films and paper or paperboard packaging products comprising the films.

The term barrier film as used herein refers generally to a thin continuous sheet formed material with low permeability for gases and/or liquids. Depending on the composition of the pulp suspension, the film can also be considered as a thin paper or even as a membrane.

The barrier film can be used as such, or it can be combined with one or more other layers. The film is for example useful as a barrier layer in a paperboard based packaging material. The barrier film may also be or constitute a barrier layer in glassine, greaseproof paper or a thin packaging paper.

The present invention is based on the realization that a relatively small portion of fines in highly refined cellulose pulp suspensions is responsible to a high degree for the high water retention and/or high drainage resistance of the suspensions and the formed webs. Traditionally, when manufacturing barrier films it has been considered important to try to retain as much of the fines as possible in the web, as the fines are also responsible to a high degree for the barrier properties of the finished films. Accordingly, previous strategies for manufacturing barrier films from highly refined cellulose have focused on measures for retaining the fines in the web during forming and dewatering, such as addition of chemical retention agents.

The present invention is instead based on the idea of rapidly dewatering the web such that a large portion of the fines are removed from the web with the white water. Preferably, the white water removed from the web contains in the range of 2-25 wt % of the solids of the highly refined cellulose pulp suspension used as starting material. The rapid dewatering and high loss of fines results in a web having relatively low density, high porosity, and occurrence of pinholes.

Due to high porosity and presence of pinholes, the obtained web, referred to herein as the substrate web, will not be suitable for use as a barrier film. However, due to a relatively even distribution of porosity and pinholes of the webs, even at high dewatering speeds, the present inventors have found that coating the substrate web with a coating comprising cellulose fines or MFC, even at very low grammages, can drastically improve the barrier properties of the web, such that a film suitable for use as a barrier film can be obtained.

In principle, the invention is based on the idea of removing fines from the bulk of the web, and then adding fines or MFC to the surface of the web. The idea of the invention may in some cases be seen as a redistribution of fines from the bulk of the web to the surface of the web. This redistribution of fines has several advantages.

The porous substrate web can be rapidly dewatered, and the porosity of the web also allows for rapid dewatering and drying of the coating comprising cellulose fines or MFC applied to the web. As a result, the inventive method allows for a rapid production of a film suitable for use as a barrier film.

Since pores and pinholes can be accepted in the substrate web, films with higher grammages which are difficult to dewater without pinhole formation can be manufactured.

The inventive method, resulting in a high local concentration of fines or MFC at the surface of the web, also allows for the total amount material in the barrier film to be reduced, while still providing similar barrier properties.

The reduction of fines in the bulk of the web has also been found to lead to films with significantly higher tearing strength than a corresponding film formed from the entire highly refined pulp with the fines retained in the bulk.

A high concentration of fines or MFC at the surface of the web can also improve the response of the surface to calendering.

Due to their high surface area, fines bind chemicals to a higher extent than coarser particles. The redistribution of fines from the bulk to the surface leads to a more even distribution of the fines, and thereby also chemicals bound to the fines, across the surface area of the web.

Although different arrangements for performing the steps of the inventive method could be contemplated by the skilled person, the inventive method may advantageously be performed in a paper machine. A paper machine (or paper-making machine) is an industrial machine which is used in the pulp and paper industry to create paper in large quantities at high speed. Modern paper-making machines are typically based on the principles of the Fourdrinier Machine, which uses a moving woven mesh, a "wire", to create a continuous web by filtering out the fibers held in a pulp suspension and producing a continuously moving wet web of fiber. This wet web is then dried in the machine to produce paper or film.

The forming and dewatering steps of the inventive method are performed at the forming section of the paper machine, commonly called the wet end. The wet web is formed on the wire in the forming section of the paper machine.

In conventional Fourdrinier machines, the web is formed on a single wire, which drains the water from the pulp suspension through the bottom. The result of this process is that the side of the web that dries against the wire, the wire side, has a different texture than the top side of the web, the felt side. A twin-wire type former, e.g. a gap former or a hybrid former, is a variation on the traditional Fourdrinier former, utilizing two wires rather than one. A twin-wire type former sandwiches the web between two wires, allowing drainage from the top and bottom of the web, producing a web with two wire sides.

The wires are preferably endless wires. The wires used in the inventive method preferably have relatively high porosity in order to allow fast dewatering and high drainage capacity. The air permeability of the wire is preferably above 4000 $m^3/m^2$/hour at 100 Pa.

The pulp suspension is applied to the wire using a headbox. The function of the headbox is to dose and distribute the pulp suspension uniformly across the width of the wire. In the headbox, the pulp suspension pumped in a pipe is converted to a uniform rectangular flow with the same flow direction and essentially the same flow rate across the width of the wire.

The headbox typically consists of a manifold distributor, flow stabilization elements and slice. The manifold distributor is a tapered header which converts the pipe flow into a rectangular flow through the slice opening with same velocity, quantity and jet thickness across the width of the wire.

The headbox serves several purposes:

(1) to provide a uniform and stable jet with a constant speed in the "machine direction" (MD) with no lateral "cross direction" (CD) components;

(2) to create controlled in the pulp suspension turbulence to disperse flocs and create a uniform suspension; and (3) to accelerate the pulp suspension up to a high speed for fast paper production.

After being formed, the wet web is dewatered on the wire. Dewatering means that the dry solids content of the wet web is increased compared to the dry solids content of the pulp suspension, but the dewatered substrate web may still comprise a significant amount of water. For the purposes of the present disclosure, the web is dewatered in the paper machine former to a consistency of at least 5 wt %.

Dewatering of the web on the wire may be performed using methods and equipment known in the art. The wire section of a paper machine may have various dewatering devices such as blade, table and/or foil elements, suction boxes, friction less dewatering, ultra-sound assisted dewatering, couch rolls, or a dandy roll. On a twin-wire type former, dewatering devices may be provided on one side or both sides of the web, allowing drainage from the top and bottom of the web.

The starting material provided in step a) of the inventive method is a highly refined cellulose pulp suspension. Refining, or beating, of cellulose pulps refers to mechanical treatment and modification of the cellulose fibers in order to provide them with desired properties. The highly refined cellulose pulp suspension is an aqueous suspension comprising a water-suspended mixture of cellulose based fibrous material and optionally non-fibrous additives. The pulp suspension can be produced from different raw materials, for example selected from the group consisting of bleached or unbleached softwood pulp or hardwood pulp, Kraft pulp, pressurized groundwood pulp (PGW), thermomechanical (TMP), chemi-thermomechanical pulp (CTMP), neutral sulfite semi chemical pulp (NSSC), broke, recycled fibers, or mixtures thereof.

The term highly refined cellulose pulp as used herein refers to a cellulose pulp which has been subjected to considerable refining, but not to the extent that all of the cellulose pulp will pass through a 200 mesh screen (equivalent hole diameter 76 μm) of a conventional laboratory fractionation device (SCAN-CM 66:05). Preferably no more than 75% of the highly refined cellulose pulp will pass through a 200 mesh screen of a conventional laboratory fractionation device according to SCAN-CM 66:05. More preferably no more than 50% of the highly refined cellulose pulp will pass through a 200 mesh screen of a conventional laboratory fractionation device according to SCAN-CM 66:05. Thus, the highly refined cellulose pulp will comprise a mixture of finer particles and coarser particles. The size distribution of the particles in the highly refined cellulose pulp may depend on the starting material and the refining processes used.

The term highly refined cellulose pulp as used herein refers to a cellulose pulp having a Schopper-Riegler (SR) number above 40 as determined by standard ISO 5267-1. The high drainage resistance of the highly refined cellulose pulp may be caused by a large portion of surface fibrillated fibers, partly swollen fiber and/or filaments released from the fibers. Preferably, the SR number of the highly refined cellulose pulp provided in step a) is in the range of 40-98. In some embodiments, the SR number of the highly refined cellulose pulp provided in step a) is in the range of 50-98, preferably in the range of 55-94, and more preferably in the range of 60-92 as determined by standard ISO 5267-1.

The highly refined cellulose pulp has a content of fibers having a length >0.2 mm of at least 7 million fibers per gram based on dry weight, preferably at least 9 million fibers per gram based on dry weight, and more preferably at least 15 million fibers per gram based on dry weight. The content of fibers having a length >0.2 mm may for example be determined using the L&W Fiber tester Plus instrument (L&W/ABB).

In some embodiments, the highly refined cellulose pulp has a mean fibril area of fibers having a length >0.2 mm of at least 15%, preferably at least 17%, more preferably at least 20%. The mean fibril area is determined using the Fiber Tester Plus instrument. "Mean fibril area" as used herein refers to length weighted mean fibril area.

The dry solids content of the highly refined cellulose pulp may be comprised solely of highly refined cellulose, or it can comprise a mixture of the highly refined cellulose and other ingredients or additives.

The highly refined cellulose pulp suspension includes highly refined cellulose as its main component based on the total dry weight of the pulp suspension. In some embodiments, the highly refined cellulose pulp suspension comprises at least 50% by dry weight, preferably at least 70% by dry weight, more preferably at least 80% by dry weight or at least 90% by dry weight of highly refined cellulose, based on the total dry weight of the highly refined cellulose pulp suspension. In some embodiments, the highly refined cellulose pulp suspension comprises in the range of 50-99% by dry weight, preferably in the range of 70-99% by dry weight, more preferably in the range of 80-99% by dry weight, and more preferably in the range of 90-99% by dry weight of highly refined cellulose, based on the total dry weight of the highly refined cellulose pulp suspension.

The highly refined cellulose pulp suspension may further comprise hemicellulose and/or lignin.

In some embodiments, the highly refined cellulose pulp suspension has a lignin content of up to 10% by weight, based on the total dry weight of the highly refined cellulose pulp suspension.

In some embodiments, the highly refined cellulose pulp suspension has a hemicellulose content in the range of 10-30% by weight, based on the total dry weight of the highly refined cellulose pulp suspension.

The highly refined cellulose pulp suspension may further comprise additives such as native starch or starch derivatives, cellulose derivatives such as sodium carboxymethyl cellulose, a filler, flocculation additives, deflocculating additives, dry strength additives, softeners, cross-linking aids, sizing chemicals, dyes and colorants, wet strength resins, fixatives, de-foaming aids, microbe and slime control aids, or mixtures thereof.

The inventive method provides an alternative way of increasing dewatering speed, which is less dependent on the addition of retention and drainage chemicals. Accordingly, the highly refined cellulose pulp suspension is preferably free from retention and drainage chemicals, but in some embodiments, small amounts of retention and drainage chemicals may still be used. In some embodiments, the highly refined cellulose pulp suspension is free from added retention and drainage chemicals.

The highly refined cellulose pulp suspension preferably comprises no more than 20% by dry weight of additives in total, based on the total dry weight of the highly refined cellulose pulp suspension. More preferably the highly refined cellulose pulp suspension comprises no more than 10% by dry weight of additives in total, based on the total dry weight of the highly refined cellulose pulp suspension.

The highly refined cellulose pulp suspension for use with the inventive method should have a consistency in the range of 0.1-1.5 wt %. Lower consistencies are not convenient for preparing webs of suitable grammage, and higher consistencies will make it difficult to efficiently drain water together with cellulose fines from the web. A consistency in the range of 0.1-1.5 wt % has been found to provide a suitable balance between grammage and efficient drainage of water together with cellulose fines. In some embodiments, the consistency of the highly refined cellulose pulp suspension provided in step a) is in the range of 0.1-1 wt %, preferably in the range of 0.2-0.8 wt %, more preferably in the range of 0.2-0.6 wt %.

The highly refined cellulose pulp is preferably produced from never dried pulp. Never dried pulp has many benefits, but one drawback is that never dried pulps are more difficult to dewater compared to dried pulps. It was found that it is possible to dewater highly refined cellulose pulp from never dried pulp with the method according to the invention in a good way.

The present invention is based on the idea of rapidly dewatering the web such that a large portion of the fines are removed from the web with the white water. During the dewatering in step b), water is removed to a consistency of at least 5 wt %. In some embodiments, the dewatering in step b) comprises dewatering the substrate web to a consistency of at least 7.5 wt %, preferably at least 10 wt %.

The white water removed from the pulp during the dewatering in step b) comprises a relatively high portion of the solids of the highly refined cellulose pulp suspension. The white water removed from the pulp contains in the range of 2-25 wt %, preferably 5-20 wt % and more preferably at least 5-15 wt % of the solids of the highly refined cellulose pulp suspension.

In some embodiments, the dry basis weight of the substrate web formed in step b) is in the range of 20-160 gsm, preferably in the range of 20-100 gsm, more preferably in the range of 20-80 gsm. However, the inventive method is advantageous in that it allows for manufacture of webs and barrier films with higher grammages, such as 40 gsm or higher, which would be difficult to dewater by conventional methods without pinhole formation. Thus, in some embodiments, the dry basis weight of the substrate web formed in step b) is in the range of 40-160 gsm, preferably in the range of 40-100 gsm, more preferably in the range of 40-80 gsm.

Due to the removal of fines during the dewatering, the substrate web formed in step b) may have a lower density than a web in which the fines had been retained to a greater extent. In some embodiments, the dry density of the substrate web formed in step b) is in the range of 550-1100 $kg/m^3$, preferably in the range of 550-1050 $kg/m^3$.

The substrate web formed in step b) has a Gurley hill porosity of 20 000 s/100 ml or less, typically 10 000 s/100 ml or less, or 5000 s/100 ml or less. More specifically, a substrate web formed in step b), which has a dry basis weight in the range of 20-80 gsm, preferably in the range of 20-40 gsm, has a Gurley hill porosity of 20 000 s/100 ml or less, typically 10 000 s/100 ml or less, or 5000 s/100 ml or less. In some embodiments, the substrate web formed in step b) has a Gurley hill porosity in the range of 100-20 000 s/100 ml, preferably in the range of 100-10 000 s/100 ml, and more preferably in the range of 100-5000 s/100 ml, as measured according to standard ISO 5636/5. Due to high porosity and presence of pinholes, the obtained substrate web will not be suitable for use as a barrier film without further modification.

A problem with webs and films formed from highly refined cellulose pulps, particularly highly refined cellulose pulps having a Schopper-Riegler (SR) number above 80, is that they will typically exhibit poor tensile and tearing strength. It has now been found that the substrate web with reduced fines formed in accordance with the inventive method will have a higher tearing strength than a corresponding web formed from the entire pulp with the fines retained. It has been found that with the inventive method a substrate web having a tear index geometrical mean (i.e. $(\text{tear index (md)} \times \text{tear index (cd)})^{1/2}$) above 3.5 $mNm^2/g$, preferably above 4 $mNm^2/g$ and more preferably above 5 $mNm^2/g$, can be formed from a highly refined cellulose pulp having an SR number above 80. The tear index geometrical mean will typically be below 10 $mNm^2/g$.

The invention is described herein mainly with reference to an embodiment wherein the substrate web is formed from a single web layer. However, it is understood that the substrate web may also comprise additional web layers. Thus, it is also possible that the formed substrate web is formed from two or more web layers. Two or more layers may for example be formed using two or more headboxes or using a multilayering headbox.

The dewatering and removal of fines is achieved in a paper machine former. The paper machine former is a wire and it can be a single-wire or a twin-wire type former. In some embodiments, the paper machine former is a single-wire type former, e.g. a fourdrinier type former. In some embodiments, the paper machine former is a twin-wire type former, e.g. a gap former or a hybrid former.

The inventors have found that using a twin-wire type former, for the forming and rapid double-sided dewatering of highly refined cellulose produces a web having distinct properties as compared to a similar web produced on a conventional single wire former, such as a fourdrinier-type former. Particularly, the double-sided dewatered web will have a more even distribution of porosity and pinholes, even at high dewatering speeds.

In some embodiments, the wire(s) have an air permeability above 4000 $m^3/m^2$/hour at 100 Pa.

The dewatering and removal of fines is preferably achieved on a wire moving at high speed and assisted by vacuum and/or pressure applied to the web.

In some embodiments, the wire(s) move at rate of at least 300 m/min, preferably at least 500 m/min, and more preferably at least 700 m/min.

A problem when manufacturing barrier films and barrier substrates from highly refined cellulose or MFC suspensions on a paper machine is that the high water retention and/or high drainage resistance of the suspensions and the formed webs lead to long dewatering times and slow production speed. Rapid or forced dewatering, e.g. assisted by pressure or suction, tends to lead to high loss of fines from the web and formation of pinholes resulting in a film with poor barrier properties. Typically for production of MFC films a dewatering time on the wire (dwell time) of at least 10 seconds is required. This is much too slow for commercial production purposes.

The inventive method allows for the dewatering time to be significantly reduced as compared to conventional film forming and dewatering methods, where the fines are retained in the web during dewatering.

In some embodiments, the dwell time of the substrate web on the wire(s) is below 7 seconds, preferably below 5 seconds, more preferably below 3 seconds.

The rapid dewatering of the web at high speed and using vacuum and/or pressure applied to the web results in that a large portion of the fines are removed from the web with the white water. Due to high porosity and presence of pinholes, the obtained substrate web will not be suitable for use as a barrier film without further modification.

In order to improve the barrier properties of the film, the substrate web is coated with a coating suspension comprising cellulose fines or MFC to obtain a coated web. The fines or MFC of the coating suspension effectively block pores and pinholes in the surface of the substrate web, and thereby drastically increase the barrier properties of the web. A majority of the fines or MFC of the coating suspension will be caught on or in the surface of the web to form a coating layer.

The term cellulose fines or microfibrillated cellulose (MFC) as used herein generally refers to cellulosic particles significantly smaller in size than cellulose fibers.

In some embodiments, the term fines or cellulose fines as used herein refers generally to fine cellulosic particles, which are able to pass through a 200 mesh screen (equivalent hole diameter 76 μm) of a conventional laboratory fractionation device (SCAN-CM 66:05). There are two major types of fiber fines, namely primary and secondary fines. Primary fines are generated during pulping and bleaching, where they are removed from the cell wall matrix by chemical and mechanical treatment. As a consequence of their origin (i.e., compound middle lamella, ray cells, parenchyma cells), primary fines exhibit a flake-like structure with only minor shares of fibrillar material. In contrast, secondary fines are generated during the refining of pulp. Both primary and secondary fines have a negative influence on dewatering in the forming section of a paper machine. Because of their large specific surface area in comparison to pulp fibers, fines also consume a high proportion of chemical additives used in pulp and paper production.

The fines of the coating suspension can be produced from different raw materials, for example selected from the group consisting of bleached or unbleached softwood pulp or hardwood pulp, Kraft pulp, pressurized groundwood pulp (PGW), thermomechanical (TMP), chemi-thermomechanical pulp (CTMP), neutral sulfite semi chemical pulp (NSSC), broke, recycled fibers, or mixtures thereof.

The cellulose fines may further comprise hemicellulose and/or lignin.

In some embodiments, the fines have a lignin content of up to 10% by weight, based on the total dry weight of the fines.

In some embodiments, the fines have a hemicellulose content in the range of 10-30% by weight, based on the total dry weight of the fines.

In some embodiments, the coating suspension comprises microfibrillated cellulose (MFC). Microfibrillated cellulose (MFC) shall in the context of the patent application mean a cellulose particle, fiber or fibril having a width or diameter of from 20 nm to 1000 nm.

Various methods exist to make MFC, such as single or multiple pass refining, pre-hydrolysis followed by refining or high shear disintegration or liberation of fibrils. One or several pre-treatment steps is usually required in order to make MFC manufacturing both energy efficient and sustainable. The cellulose fibers of the pulp used when producing MFC may thus be native or pre-treated enzymatically or chemically, for example to reduce the quantity of hemicellulose or lignin. The cellulose fibers may be chemically modified before fibrillation, wherein the cellulose molecules contain functional groups other (or more) than found in the original cellulose. Such groups include, among others, carboxymethyl (CM), aldehyde and/or carboxyl groups (cellulose obtained by N-oxyl mediated oxidation, for example "TEMPO"), or quaternary ammonium (cationic cellulose). After being modified or oxidized in one of the above-described methods, it is easier to disintegrate the fibers into MFC.

MFC can be produced from wood cellulose fibers, both from hardwood and softwood fibers. It can also be made from microbial sources, agricultural fibers such as wheat straw pulp, bamboo, bagasse, or other non-wood fiber sources. It can be made from pulp, including pulp from virgin fiber, e.g. mechanical, chemical and/or thermomechanical pulps. It can also be made from broke or recycled paper.

The solids of the coating suspension are preferably comprised mainly of the cellulose fines or MFC. In some embodiments the coating suspension comprises at least 50%, preferably at least 60%, at least 70%, at least 80%, or at least 90%, cellulose fines based on the dry weight of the coating suspension. In some embodiments, the solids of the coating suspension comprise in the range of 50-99% by dry weight, preferably in the range of 60-99% by dry weight, more preferably in the range of 70-99% by dry weight, more preferably in the range of 80-99% by dry weight, and more preferably in the range of 90-99% by dry weight of cellulose fines, based on the total dry weight of the coating suspension.

The coating suspension may comprise a water-suspended mixture of cellulose fines or MFC and optionally non-fibrous additives.

In some embodiments the coating suspension further comprises nanoparticles and/or an anti-slip agent.

In some embodiments the coating suspension comprises cellulose fines obtained by fractionation of a highly refined cellulose pulp, i.e. separating the solids of a highly refined cellulose pulp into a coarse fraction and a fines fraction.

In some embodiments the coating suspension comprises cellulose fines obtained from the white water removed in step b).

Fines from fractionation or from the white water removed in step b) can be used as such, or first be subjected to additional treatment, such as enzymatic (e.g. cellulase) treatment, refining, and/or high pressure fluidization.

The coating suspension can be applied using various methods, including but not limited to a headbox, spray coating, or curtain coating. When using these types of deposition techniques, the application can be made in a single deposition step or using multiple deposition steps in order to get more even coating and not disturb the formation of the substrate web. Application of the coating suspension can for example be achieved using at least two consecutive spraying or curtain coating units applying same or substantially the same coating suspension. In a preferred embodiment, the coating suspension is applied by curtain coating. In some embodiments, the coating suspension is applied by foam coating.

In some embodiments, the substrate web obtained in step b) is coated while it is still wet. In some embodiments, the substrate web is subjected to further dewatering and/or drying before the coating is applied. The optional further dewatering in step c) may be performed on a wire using methods and equipment known in the art, examples include but are not limited to table roll and foils, suction boxes, friction less dewatering and ultra-sound assisted dewatering. The optional further dewatering in step c) may also comprise pressing the substrate web to squeeze out as much water as possible. The further dewatering may for example include passing the formed substrate web through a press section of a paper machine, where the web passes between large rolls loaded under high pressure to squeeze out as much water as possible. In some embodiments the further dewatering comprises passing the substrate web through one or more shoe presses. The removed water is typically received by a fabric or felt. In some embodiments, the dry solids content of the substrate web after the further dewatering is in the range of 15-48 wt %, preferably in the range of 18-40 wt %, and more preferably in the range of 22-35 wt %. The optional drying may for example include drying the substrate web by passing the web around a series of heated drying cylinders. Drying may typically reduce the water content down to a level of about 1-15 wt %, preferably to about 2-10 wt %.

In some embodiments the coating suspension has a temperature in the range of 40-95° C., preferably in the range of 50-95° C., and more preferably in the range of 60-95° C.

The present inventors have found that due to a relatively even distribution of porosity and pinholes of the substrate web, even at high dewatering speeds, coating the substrate web with a coating comprising cellulose fines or MFC, even at very low grammages, can drastically improve the barrier properties of the web, such that a film suitable for use as a barrier film can be obtained. In some embodiments, the dry coat weight of cellulose fines or MFC coated on the web in step d) is in the range of 0.1-10 gsm, preferably in the range of 0.1-5 gsm, more preferably in the range of 0.1-3. gsm. In some embodiments, the dry coat weight of cellulose fines or MFC coated on the web in step d) is in the range of 0.1-3 gsm, preferably in the range of 0.1-2.5 gsm, more preferably in the range of 0.1-1.75 gsm.

In some embodiments, the coating suspension is only applied on one side of the substrate web. In some embodiments the coating suspension is applied on both sides of the substrate web.

Because of the low grammage of cellulose fines or MFC coated on the web, the dry basis weight of the coated web obtained in step d) may not differ much from the dry basis weight of the substrate web obtained in step b). In some embodiments, the dry basis weight of the coated web obtained in step d) is in the range of 20-160 gsm, preferably in the range of 20-100 gsm, more preferably in the range of 20-80 gsm.

The coating of the substrate web has been found to substantially eliminate occurrence of pinholes in the finished barrier film, while still allowing a high production speed. In the prior art, increased dewatering speed has sometimes been achieved by using large amounts of retention and drainage chemicals at the wet end of the process, causing increased flocculation. However, retention and drainage chemicals may also cause a more porous web structure, and thus there is a need to minimize the use of such chemicals. The inventive method provides an alternative way of increasing dewatering speed, which is less dependent on the addition of retention and drainage chemicals. In some embodiments, the coating suspension is free from added retention and drainage chemicals.

The substrate web may be wet or dry when the coating suspension is applied. In some embodiments, the coating suspension is applied to the dewatered, but not yet dried substrate web. The coated web is then subsequently further dewatered and optionally dried to obtain a barrier film. In some embodiments, the coating suspension is applied before the web enters a press section of a paper machine.

The coated web is subsequently further dewatered and optionally dried to obtain a barrier film comprising highly refined cellulose. In the dewatering and/or drying step e), the dry solids content of the coated web is further increased. The resulting barrier film preferably has a dry solids content above 90 wt %.

The water of the coating suspension can be removed by drainage through the less drainage resistant substrate web, or by drying, or by a combination thereof. The drainage and/or drying of the coated web results in a barrier film comprising highly refined cellulose.

Further dewatering of the coated web on the wire may be performed using methods and equipment known in the art. The wire section of a paper machine may have various dewatering devices such as blade, table and/or foil elements, suction boxes, friction less dewatering, ultra-sound assisted dewatering, couch rolls, or a dandy roll. Dewatering in this step is preferably one sided and performed from the bottom side of the web in order to avoid loss of coated cellulose fines or MFC from the web surface.

The further dewatering may also comprise pressing the coated web to squeeze out as much water as possible. The further dewatering may for example include passing the formed coated web through a press section of a paper machine, where the web passes between large rolls loaded under high pressure to squeeze out as much water as possible. In some embodiments the further dewatering comprises passing the coated web through one or more shoe presses. The removed water is typically received by a fabric or felt. In some embodiments, the dry solids content of the coated web after the further dewatering is in the range of 15-48 wt %, preferably in the range of 18-40 wt %, and more preferably in the range of 22-35 wt %.

The optional drying may for example include drying the coated web by passing the web around a series of heated drying cylinders. Drying may typically reduce the water content down to a level of about 1-15 wt %, preferably to about 2-10 wt %. In some embodiments, the drying comprises drying the web on a Yankee cylinder. The Yankee cylinder can also be used to produce a glazed surface on the finished film.

The dry solids content of the final barrier film may vary depending on the intended use of the film. For example, a barrier film for use as a stand-alone product may have a dry solids content in the range of 85-99 wt %, preferably in the range of 90-98 wt %, whereas a film for use in further lamination to form paper or paperboard based packaging material may have a dry solids content in the range of less than 90 wt %, preferably less than 85 wt %, such as in the range of 30-85 wt %.

The coating with cellulose fines or MFC, even at very low grammages, can drastically improve the barrier properties of the web, such that a film suitable for use as a barrier film can be obtained. The coated substrate formed in step d) has a Gurley hill porosity which is higher, preferably significantly higher, than the Gurley hill porosity of the uncoated substrate web. The coated substrate formed in step d) typically has a Gurley hill porosity of 5000 s/100 ml or higher, typically 20 000 s/100 ml or higher, or 40 000 s/100 ml or higher, as measured according to standard ISO 5636/5. More specifically, a coated substrate formed in step d), which has a dry basis weight in the range of 20-80 gsm, preferably in the range of 20-40 gsm, has a Gurley hill porosity of 5000 s/100 ml or higher, typically 20 000 s/100 ml or higher, or 40 000 s/100 ml or higher, as measured according to standard ISO 5636/5.

Pinholes are microscopic holes that can appear in the web during the forming process. Examples of reasons for the appearance of pinholes include irregularities in the pulp suspension, e.g. formed by flocculation or re-flocculation of fibrils, rough dewatering fabric, uneven pulp distribution on the wire, or too low a web grammage. In some embodiments, the barrier film comprises less than 10 pinholes/$m^2$, preferably less than 8 pinholes/$m^2$, and more preferably less than 2 pinholes/$m^2$, as measured according to standard EN13676:2001. The measurement involves treating the barrier film with a coloring solution (e.g. dyestuff E131 Blue in ethanol) and inspecting the surface microscopically.

The barrier film will typically exhibit good resistance to grease and oil. Grease resistance of the barrier film is evaluated by the KIT-test according to standard ISO 16532-2. The test uses a series of mixtures of castor oil, toluene and heptane. As the ratio of oil to solvent is decreased, the viscosity and surface tension also decrease, making successive mixtures more difficult to withstand. The performance is rated by the highest numbered solution which does not darken the sheet after 15 seconds. The highest numbered solution (the most aggressive) that remains on the surface of the paper without causing failure is reported as the "kit rating" (maximum 12). In some embodiments, the KIT value of the barrier film is at least 8, preferably at least 10, as measured according to standard ISO 16532-2. The barrier film typically has an oxygen transfer rate (OTR), measured according to the standard ASTM D-3985 at 50% relative humidity and 23° C., of less than 1000 cc/$m^2$/day. In some embodiments, the barrier film has an oxygen transfer rate (OTR), measured according to the standard ASTM D-3985 at 50% relative humidity and 23° C., of less than 100 cc/m$^2$/day, preferably less than 50 cc/m$^2$/day, more preferably less than 10 cc/m$^2$/day.

The barrier film preferably has high repulpability. In some embodiments, the barrier film exhibits less than 30%, preferably less than 20%, and more preferably less than 10% or less than 5% or less than 2% residues, when tested as a category II material according to the PTS-RH 021/97 test method.

A barrier film formed from a substrate web with reduced fines formed in accordance with the inventive method will have a significantly higher tearing strength than a corresponding barrier film formed from a substrate web with the fines retained. It has been found that with the inventive method a substrate web, and thereby also a barrier film comprising the substrate web, having a tear index geometrical mean (i.e. (tear index (md)×tear index (cd))$^{1/2}$) above 3.5 mNm$^2$/g, preferably above 4 mNm$^2$/g and more preferably above 5 mNm$^2$/g, can be formed from a highly refined cellulose pulp having an SR number above 80. The tear index geometrical mean will typically be below 10 mNm$^2$/g.

According to a second aspect illustrated herein, there is provided a barrier film comprising highly refined cellulose, wherein the barrier film is obtainable by the inventive method.

As mentioned, it has now been found that the substrate web with reduced fines formed in accordance with the inventive method, and a barrier film formed from such a substrate web, will have a significantly higher tearing strength than a corresponding web formed from the entire pulp with the fines retained. It has further been found that with the inventive method a substrate web, or a barrier film formed from such a substrate web, having a tear index geometrical mean (i.e. (tear index (md)×tear index (cd))$^{1/2}$) above 3.5 mNm$^2$/g, preferably above 4 mNm$^2$/g and more preferably above 5 mNm$^2$/g, can be formed from a highly refined cellulose pulp having an SR number above 80.

Thus, in some embodiments, the barrier film is formed from a highly refined cellulose pulp having an SR number above 80 and has a tear index geometrical mean (i.e. (tear index (md)×tear index (cd))$^{1/2}$) above 3.5 mNm$^2$/g, preferably above 4 mNm$^2$/g and more preferably above 5 mNm$^2$/g. The tear index geometrical mean will typically be below 10 mNm$^2$/g.

The barrier film can be used as such, or it can be combined with one or more other layers. The film is for example useful as a barrier layer in a paperboard based packaging material. The barrier film may also be or constitute a barrier layer in glassine, greaseproof paper or a thin packaging paper.

The inventive barrier films are especially suited as thin packaging films when coated or laminated with one or more layers of a thermoplastic polymer. Thus, the barrier film may in some embodiments be coated or laminated with one or more polymer layers.

Generally, while the products, polymers, materials, layers and processes are described in terms of "comprising" various components or steps, the products, polymers, materials, layers and processes can also "consist essentially of" or "consist of" the various components and steps.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

EXAMPLES

Example 1 (Comparative)

Highly refined softwood pulp refined to an SR value >90 and having a fibril area of about 20% (>0.2 mm) and an amount of fibers of about 15 million per gram of sample (>0.2 mm) determined using the L&W Fiber tester Plus instrument (L&W/ABB), was prepared at a pH about 7 and consistency of 1.7 wt % and run on a pilot paper machine. The specific formation was 0.51, which is relatively good, and the tensile index ratio (md/cd) of the formed film was about 2. The results are presented in Table 1.

This example showed that a dense barrier film can be prepared from the highly refined pulp, but because the drainage resistance of the pulp is very high, the machine speed had to be kept very low (30 m/min), and hence web manufacturing will be very slow.

Example 2 (Comparative)

Highly refined softwood pulp refined to an SR value >90 and having a fibril area of about 20% (>0.2 mm) and an amount of fibers of about 15 million per gram of sample (>0.2 mm) determined using the L&W Fiber tester Plus instrument (L&W/ABB), was prepared at a pH about 7 and consistency of 1.7 wt % and run on a full-scale paper machine with a fourdrinier layout. The specific formation was about 0.7 and tensile index ratio about 2.

The machine speed had to be reduced to about 130 m/min due to high drainage resistance of the pulp. The amount of solids removed through the wire during dewatering was about 2 wt % of the solids of the highly refined cellulose pulp used as starting material.

The results in Table 1 below show that a dense sheet can be made, but due to high drainage resistance, the manufacturing speed is low and the formation and evenness of the base is also impacted negatively.

Example 3

Highly refined softwood pulp refined to an SR value >90 and having a fibril area of about 20% (>0.2 mm) and an amount of fibers of about 15 million per gram of sample (>0.2 mm) determined using the L&W Fiber tester Plus instrument (L&W/ABB), was prepared and diluted to a consistency of 0.5-0.6 wt % and run at a pH of 6.5-8 at a temperature in the range of 37-44° C. in a twin-wire hybrid former at a speed of 500 m/min.

The concentration of solids in the white water removed from the pulp during the dewatering was about 0.05 wt %, which means that the amount of solids removed through the wire during dewatering was about 10 wt % of the solids of the highly refined cellulose pulp used as starting material.

This example confirms that a web containing high amount of highly refined pulp can be dewatered at higher speed, and that this leads to a web with increased air permeability due to removal of a significant portion of the fine solids from the pulp (i.e. fractionation).

Interestingly, it was noted that the specific formation was 0.43, which is very good and tensile index ratio was 3.75, which is very high. Also, the tearing resistance was very good, confirming that subjecting the pulp to fractionation has a positive effect on the web strength.

Example 4 (Comparative)

Softwood pulp refined to a SR of 82 and having a fibril area of about 17% (>0.2 mm) and an amount of fibers of about 11 million per gram (>0.2 mm) determined using the L&W Fiber tester Plus instrument (L&W/ABB), was prepared to a sheet in a Formette unit (lab device). The grammage of the formed sheet was 30 gsm. The OTR determined at 23° C./50% RH for the sheet was 189 cc/m$^2$/day, which confirms that the sheet has some barrier properties but is not on the same level as in comparative Example 1. This is mainly due to slightly coarser fiber material than in Example 1.

Example 5

This example was performed in order to demonstrate the effect of coating a substrate web formed from a highly refined cellulose pulp with a coating comprising fine cellulosic material in the form of microfibrillated cellulose (MFC).

This example used same refined softwood pulp as in Example 4. A 25 gsm sheet was formed from the pulp in a Formette unit and a 5 gsm MFC layer was subsequently applied on the sheet using a spray device. The MFC was prepared by treating softwood fiber with enzyme (cellulase) prior to high pressure fluidization. The MFC coating was applied to the substrate web after dewatering, but before drying. The basis weight of substrate web was 25 gsm, and the amount of MFC applied to the web was 5 gsm. The OTR determined at 23° C./50% RH for the coated sheet was 3, which confirmed the effect of applying a fine MFC to the sheet surface.

Example 6

Example 1 was repeated on a pilot paper machine but now with a 30% addition of unrefined softwood pulp to the highly refined cellulose pulp. This gave a highly porous substrate web with no barrier properties.

Subsequently, an MFC coating as used in Example 5 was applied to the dewatered but not dried web by wet curtain coating.

The OTR of the coated substrate determined at 23° C./50% RH was 565 cc/m$^2$/day. This relatively low OTR confirmed that the MFC coating can close the surface despite a very high particle/fiber size distribution in the substrate web as represented by the addition of 30% of unrefined fiber to the highly refined pulp.

TABLE 1

| | 1 | 2 | 3 | 4 (Formette) | 5 (Formette) | 6 |
|---|---|---|---|---|---|---|
| Furnish | | | | | | |
| Refined pulp (SR > 90) | 100% | 100% | 100% | | | 70% |
| Refined pulp (SR 82) | | | | 100% | 100% | |
| Pulp (softwood) | | | | | | 30% |
| Coating (wet on wet) | | | | | Yes | Yes |
| Dewatering | Single wire | Single wire | Twin wire | Single wire | Single wire | Single wire |
| Fiber fraction removed | <1% | <2% | 10% | N.D. | N.D. | N.D. |
| Speed, m/min | 30 | 130 | 500 | N.D. | N.D. | 30 |
| Sheet properties | | | | | | |
| Grammage, g/m$^2$ | 31 | 31.8 | 37 | 30 | 25 + 5 | 32 |
| Density | 669 | 725 | 899 | N.D. | N.D. | N.D. |
| Gurley Hill s/100 ml | N.D. | 42300 | 5614 | N.D. | N.D. | N.D. |
| OTR, 23/50 cc/m$^2$/day | 7 | Fail/ >3100 | Fail/ >3100 | 189 | 3 | 565 |
| Specific Formation | 0.51 | 0.73 | 0.43 | N.D. | N.D. | N.D. |
| Tensile index, md | 117 | 90.4 | 105 | N.D. | N.D. | N.D. |
| Tensile index, cd | 54.7 | 45 | 28 | N.D. | N.D. | N.D. |
| Tensile strength, Geometric mean | 2.49 | 2.03 | 1.99 | N.D. | N.D. | N.D. |
| Tensile index ratio (md/cd) | 2.1 | 2 | 3.75 | N.D. | N.D. | N.D. |
| Tearing index, cd | 3.6 | 3.5 | 4.7 | N.D. | N.D. | N.D. |
| Tearing index, md | 3 | 3.4 | 6.6 | N.D. | N.D. | N.D. |
| Tearing resistance, Geometric mean | 101 | 110 | 206 | N.D. | N.D. | N.D. |

Tensile index (Nm/g): ISO 1924-3
Specific Formation (g^0.5/m): SCAN-P 92
Tear index (mNm$^2$/g): ISO 1974
Grammage (g/m$^2$): ISO 536
Tearing resistance (mN): ISO 1974
Air resistance (s/100 ml), Gurley Hill: ISO 5636/5
Bulk, single sheet (cm$^3$/g): ISO 534
md = machine direction
cd = cross direction
N.D. = Not determined

The invention claimed is:

1. A method for manufacturing a barrier film comprising highly refined cellulose, said method comprising:

a) providing a highly refined cellulose pulp suspension comprising at least 80% by a total dry weight of highly refined cellulose from a highly refined cellulose pulp having a Schopper-Riegler (SR) number in the range of 40-98 as determined by standard ISO 5267-1 and a content of fibers having a length >0.2 mm of at least 7 million fibers per gram based on a dry weight, at a consistency in a range of 0.1-1.5 wt %;

b) forming a web of the highly refined cellulose pulp suspension and dewatering the web in a paper machine former on a wire to a consistency of at least 5 wt % to obtain a substrate web, wherein a dwell time of the substrate web on the wire is below 7 seconds and a white water removed from the pulp contains 2-25 wt % of solids of the highly refined cellulose pulp suspension provided in step a);

c) optionally further dewatering and optionally drying the substrate web;

d) coating the substrate web with a coating suspension comprising cellulose fines or microfibrillated cellulose to obtain a coated web; and e) dewatering, drying or both, the coated web to obtain a barrier film comprising highly refined cellulose.

2. The method according to claim 1, wherein the consistency of the highly refined cellulose pulp suspension provided in step a) is in a range of 0.1-1 wt %.

3. The method according to claim 1, wherein step b) comprises dewatering the substrate web to a consistency of at least 7.5 wt %.

4. The method according to claim 1, wherein a dry basis weight of the substrate web formed in step b) is in a range of 20-160 gsm.

5. The method according to claim 1, wherein a dry density of the substrate web formed in step b) is in a range of 550-1100 kg/m$^3$.

6. The method according to claim 1, wherein the substrate web formed in step b) has a Gurley hill porosity in a range of 100-20 000 s/100 ml, as measured according to standard ISO 5636/5.

7. The method according to claim 1, wherein the paper machine former is a single-wire type former.

8. The method according to claim 1, wherein the paper machine former is a twin-wire type former.

9. The method according to claim 1, wherein the wire has an air permeability above 4000 m$^3$/m$^2$/hour at 100 Pa.

10. The method according to claim 1, wherein the wire moves at rate of at least 300 m/min.

11. The method according to claim 1, wherein the dwell time of the substrate web on the wire is below 5 seconds.

12. The method according to claim 1, wherein the dewatering is assisted by vacuum, or pressure, or both.

13. The method according to claim 1, wherein the coating suspension comprises at least 50% cellulose fines or MFC based on a dry weight of the coating suspension.

14. The method according to claim 1, wherein the coating suspension further comprises nanoparticles, or an anti-slip agent, or both.

15. The method according to claim 1, wherein the coating suspension comprises cellulose fines obtained by a fractionation of a highly refined cellulose pulp.

16. The method according to claim 1, wherein the coating suspension comprises cellulose fines obtained from the white water removed in step b).

17. The method according to claim 1, wherein the coating suspension is applied by curtain coating.

18. The method according to claim 1, wherein the coating suspension has a temperature in a range of 40-95° C.

19. The method according to claim 1, wherein a dry coat weight of cellulose fines or MFC coated on the web in step d) is in the range of 0.1-10 gsm.

20. The method according to claim 1, wherein a dry basis weight of the coated web obtained in step d) is in a range of 20-160 gsm.

21. The method according to claim 1, wherein the coated web obtained in step d) has a Gurley hill porosity of 5000 s/100 ml or higher, as measured according to standard ISO 5636/5.

22. A barrier film obtained by the method according to claim 1.

23. The barrier film according to claim 22, wherein the barrier film is formed from a highly refined cellulose pulp having an SR number above 80 and has a tear index geometrical mean (i.e. (tear index (md)×tear index (cd))$^{1/2}$) above 3.5 mNm$^2$/g.

* * * * *